US008662268B2

(12) United States Patent
Keir

(10) Patent No.: US 8,662,268 B2
(45) Date of Patent: Mar. 4, 2014

(54) ARTICLE OF LUGGAGE WITH SUPPORTING FRAME

(75) Inventor: Alex Keir, Oldham (GB)

(73) Assignee: UP Global Sourcing UK Limited, Oldham (GB)

( * ) Notice: Subject to any disclaimer, the term of this patent is extended or adjusted under 35 U.S.C. 154(b) by 116 days.

(21) Appl. No.: 13/272,898

(22) Filed: Oct. 13, 2011

(65) Prior Publication Data

US 2012/0090934 A1 Apr. 19, 2012

(30) Foreign Application Priority Data

Oct. 18, 2010 (GB) ..... 1017526.3

(51) Int. Cl.
*A45C 5/14* (2006.01)
*A45C 13/04* (2006.01)
*A45C 13/26* (2006.01)

(52) U.S. Cl.
USPC ..... 190/39; 190/18 A; 190/24; 190/115; 190/122; 280/655.1

(58) Field of Classification Search
CPC ..... A45C 5/14; A45C 13/04; A45C 13/26
USPC ..... 190/24, 39, 115, 903, 122, 127, 18 A; D3/289; 280/655.1
See application file for complete search history.

(56) References Cited

U.S. PATENT DOCUMENTS 1,139,726 A * 5/1915 Roberts ..... 190/24
2,840,142 A * 6/1958 Sands ..... 280/30
2,861,661 A * 11/1958 Heitler ..... 190/122
4,435,115 A * 3/1984 Orstad et al. ..... 414/490
4,795,186 A * 1/1989 Tyus ..... 280/651
4,813,520 A 3/1989 Lin
5,031,734 A * 7/1991 King ..... 190/122
5,056,695 A * 10/1991 Giblet ..... 224/484
5,630,521 A * 5/1997 Waddell et al. ..... 190/18 A
5,653,319 A * 8/1997 Wang ..... 190/115
5,833,039 A * 11/1998 Kotkins, Jr. ..... 190/115
5,921,574 A * 7/1999 Driessen et al. ..... 280/655.1
5,927,514 A * 7/1999 Linder ..... 211/26
6,129,365 A * 10/2000 Sadow ..... 280/47.26

(Continued)

FOREIGN PATENT DOCUMENTS

EP 2 039 262 A2 3/2009
EP 2039262 3/2009

(Continued)

*Primary Examiner* — Sue A Weaver
(74) *Attorney, Agent, or Firm* — Notaro, Michalos & Zaccaria P.C.

(57) ABSTRACT

An article of luggage comprises a suitcase with a substantially cuboid fabric structure supported by a frame. A set of wheels and an upward and rearward projecting handle are mounted on the frame. The suitcase is stable in an upright position. A user may incline the handle of the suitcase rearward from the upright position to wheel the suitcase. Thus, the suitcase need not be orientated far from the vertical when being wheeled by a user. The handle may be fixed but is preferably telescopic. The frame has a plurality of elongate members connected to form a frame base and a frame top spaced apart by diagonal length members connected between the front of the base and the rear of the top. The handle is mounted to the diagonal length members and the wheels are mounted to the frame base.

23 Claims, 7 Drawing Sheets

(56) References Cited

U.S. PATENT DOCUMENTS

| | | | | |
|---|---|---|---|---|
| 6,131,713 | A * | 10/2000 | Sher | 190/122 |
| 6,357,567 | B1 * | 3/2002 | Tsai | 190/18 A |
| 6,443,274 | B1 * | 9/2002 | Klamm | 190/18 A |
| D493,283 | S * | 7/2004 | Rada et al. | D3/279 |
| 2004/0031654 | A1 * | 2/2004 | Chang | 190/18 A |
| 2008/0236972 | A1 | 10/2008 | Lee et al. | |

FOREIGN PATENT DOCUMENTS

| | | |
|---|---|---|
| GB | 2361692 | 10/2001 |
| GB | 2441580 | 3/2008 |
| GB | 2440206 | 10/2008 |
| WO | WO 96/20620 | 7/1996 |
| WO | WO 98/08721 | 3/1998 |
| WO | WO 03/063637 | 8/2003 |

* cited by examiner

ARTICLE OF LUGGAGE WITH SUPPORTING FRAME

BACKGROUND OF THE INVENTION

Field of the Invention

The present invention relates to an article of luggage and a frame therefor and in particular to a wheeled suitcase or the like.

A popular form of luggage is the wheeled suitcase. This typically comprises a supporting frame upon which is provided a set of wheels, a towing handle and an enclosable storage volume. Typically such suitcases are of substantially cuboid form in view of the fact that airline baggage restrictions are typically defined in terms of maximum length, width and depth dimensions. Additionally and advantageously, the cuboid form may allow for easy and/or efficient packing in a confined volume such as a car boot or an aircraft hold.

Defined conventionally, a wheeled suitcase has a zipped flap covering a substantial portion of a front face of the suitcase. Wheels are provided at opposite sides of the rear edge of the base of the suitcase whilst the towing handle projects telescopically from the rear edge of the suitcase. In this manner, the suitcase can typically balance stably (assuming balanced packing) on at least its base and rear surfaces. The suitcase may be inclined rearward from its base and wheeled either in front or, more commonly, behind a user.

In the past, such suitcases were typically provided with a frame comprising a plurality of substantially rigid panels. These panels might comprise the top, base, sides and rear of the suitcase. As weight restrictions have become more common on airlines, there is now a desire to reduce the weight of the suitcase such that a greater weight of contents may be carried. This had led to suitcases of the type disclosed in GB2361692, GB2440206 and GB2441580. These suitcases comprise elongate supporting members provided along each edge of the suitcase, the elongate members being connected together at each corner of the suitcase by suitable connection pieces. The provision of these elongate supporting members along each edge rather than rigid panels reduces weight whilst maintaining a reasonable level of protection for the suitcase and its contents. Nevertheless, as airline baggage allowances continue to be reduced, there is demand for still lighter suitcases which provide sufficient protection.

In common with the designs incorporating rigid panels, the specified prior art designs above effectively prevent access to the interior of the storage volume except via a front flap. This can cause difficulties when packing or unpacking large objects or if there is a desire to retrieve an object packed towards the rear of the storage volume.

Another difficulty with known wheeled suitcase designs is related to the inclination when being wheeled. Typically, with the handle extended parallel to the rear face or the suitcase, the suitcase may be inclined significantly from the vertical. The greater this angle is, the more significant the proportion of the suitcase weight that must be borne by the user. Over time this can become uncomfortable and tiring. Additionally, tilting at a greater angle displaces the centre of mass of the suitcase further from the wheels. This means that the suitcase can be more readily upset when being wheeled over an uneven surface.

SUMMARY OF THE INVENTION

It is therefore an object of the present invention to provide a solution that at least partially overcomes or alleviates the above problems.

According to a first aspect of the present invention there is provided an article of luggage comprising: a supporting frame; an enclosable storage volume provided upon the supporting frame; a set of wheels provided at a rear edge of a base of the supporting frame; and a towing handle provided at rear edge of a top of the supporting frame, and wherein the towing handle projects both upward and rearward from the article of luggage.

This provides an article of luggage that can be wheeled in a more upright position than known from the prior art. This reduces the proportion of the weight of the luggage that must be supported by the user and reduces the likelihood of upset when wheeled over an uneven surface.

The towing handle may comprise a cross member provided between a pair of upward and rearward projecting members. The towing handle may be a telescopic towing handle. In such instances, the upward and rearward projecting members may be adapted to extend from and be received by suitable handle sleeves. Additionally or alternatively, the upward and rearward projecting members may be comprised of two or more telescopically extendable sections. The handle sleeves may be mounted to the supporting frame or may be incorporated into the supporting frame.

The enclosable storage volume may be provided within the supporting frame. The enclosable storage volume may enclose the frame with the exception of the towing handle.

The enclosable storage volume may be defined by a substantially cuboid fabric structure attached to the supporting frame. The fabric structure may comprise one or more layers of fabric. In particular, the fabric structure may comprise a relatively hard wearing and/or water resistant outer layer and a softer inner layer. In some embodiments, protective padding may be provided between the layers. In further embodiments, one or more rigid or semi-rigid reinforcing panels may additionally or alternatively be provided between the layers.

The fabric structure may comprise one or more access flaps. The one or more access flaps allow access to the interior of the enclosable storage volume. The one or more access flaps may be securely and reversibly closed by any suitable means, for instance, a zip or similar. The fabric structure may further incorporate one or more internal or external pockets. The internal or external pockets may be open or may be securely and reversibly closed as required or desired.

The frame may comprise a plurality of substantially rigid elongate members. The elongate members may have a tubular form. The elongate members may be formed from a suitable metal. In a preferred embodiment, the elongate members may be formed from aluminium which has the benefit of being relatively lightweight.

The elongate members may be connected together at their ends by suitable corner connection joints. The corner connection joints may be adapted to push-fit together with the elongate members. In a preferred embodiment, the corner connection joints may be formed from a suitable plastic.

In a preferred embodiment, the supporting frame comprises: a frame base having a rear edge member connected to two side edge members; a frame top having a front edge member connected to two side edge members; and a pair of diagonal length members connected between the front of the frame base and the rear of the frame top.

This construction provides significant structural strength and protection for an article of luggage (and its contents) without requiring rigid panels and with less supporting members (eight) than is known from the prior art frames (twelve). In particular, the frame provides two members supporting each of the vertices of the cuboid fabric structure, direct support for three edges of both the frame base and the frame top, as well as providing the length members for maintain the spacing between the frame top and frame base and protecting against side impacts.

In another preferred embodiment, the supporting frame comprises: a frame base having front and rear edge members connected to two side edge members; a frame top having a front and rear edge members connected to two side edge members; parallel length side members connecting the each vertex of the frame top with the corresponding vertex of the frame base; and a pair of diagonal length members connected between the front of the frame base and the rear of the frame top.

This construction provides significant structural strength and protection for an article of luggage (and its contents) without requiring rigid panels. In particular, the provision of the diagonal length members can significantly strengthen the frame, particularly with respect to forces applied along or around the length of the frame. In particular, the frame provides at least three members supporting each of the vertices of the cuboid fabric structure. By the provision of the diagonal length members, the other members and in particular the parallel length side members, may be formed of relatively lighter weight material whilst still retaining an acceptable structural strength.

The front edge member and two side edge members of the frame top may be formed from a single member bent into a U shape. This can simplify construction.

The handle sleeves may be mounted adjacent and parallel to the diagonal length members. Advantageously, in such embodiments, the cross member of the towing handle effectively provides a rear edge member giving additional support to the rear edge of the frame top.

In some alternative embodiments, the diagonal length members may be the handle sleeves. In such instances, the corner connection joints between the diagonal length members and the frame top are specially adapted to allow the towing handle to pass therethrough. Additionally, in such embodiments, the diagonal length members may be adapted to have an increased diameter.

The front of the base may be provided with two or more feet for supporting the suitcase when in an upright position. The feet may be provided on the corner connection joints between the diagonal length members and the side edge members of the frame base.

The wheels may be mounted upon the corner connection joints between the rear and side edge members of the frame base. In some embodiments, additional wheels may be provided on the corner connection joints between the diagonal length members and the side edge members of the frame base. In such embodiments, the additional wheels may be provided in place of the feet.

In some embodiments, one or more supplementary members may be provided. In particular, these supplementary members may be provided at the front edge of the frame base and/or at the rear edge or the frame top. The supplementary members may be of the same form as the other elongate members or may be of a different, typically lighter, form. In one preferred embodiment, the supplementary members comprise a glass fibre rod. The supplementary members may be attached to the corner connection joints provided.

In embodiments wherein the fabric structure is mounted within the frame, the frame may be provided with one or more tabs. The tabs may be in the form of curved corner surfaces. The tabs may be mounted on the members, supplementary members or the corner connector joints. The tabs may merely provide support to the fabric structure. Additionally or alternatively, some or all tabs may provide attachment points between the frame and the fabric structure. Such tabs may be releaseably attached or permanently attached to the fabric structure. If the tabs are permanently attached, this might be achieved by adhesive, stitching, staples, pins or the like. If the tabs are releaseably attached, this might be achieved by fasteners such as hook and loop fabric, snap fitting clips or the like. Releaseable attachment may facilitate the swapping of one fabric structure for another fabric structure. This can allow users to replace a damaged fabric structure or substitute a fabric structure with a different colour, pattern, pocket arrangement or similar as desired or required.

In embodiments having a frame comprises diagonal length members but no parallel length side members at the front, the front flap of the enclosable storage volume may be adapted to comprise all or substantially all of the front face of the substantially cuboid fabric structure and half or substantially half of one of the sides of the substantially cuboid fabric structure. In some implementations, the flap may further comprise half or substantially half of a second one of the sides of the substantially cuboid fabric structure. The half or substantially half of the sides may comprise the upper part of the sides being above and forward of the diagonal length member. In this manner easy and ready access is provided to the interior of the storage volume. In particular, a user may more readily access articles packed close to the rear of the storage volume than is usual with prior art suitcases.

According to a second aspect of the present invention there is provided a supporting frame for an article of luggage, the frame comprising: a frame base having a rear edge member connected to two side edge members; a frame top having a front edge member connected to side edge members; and a pair of diagonal length members connected between the front of the base and the rear of the top; a set of wheels mounted at the rear of the base; and a towing handle projecting upward and rearward from rear of the top.

The frame of the second aspect of the present invention may incorporate any or all features of the first aspect of the present invention as desired or as appropriate.

According to a third aspect of the present invention there is provided an article of luggage comprising: a supporting frame; an enclosable storage volume in the form of a substantially cuboid fabric structure provided upon the supporting frame; a set of wheels provided at a rear edge of a base of the supporting frame; and a towing handle provided at a rear edge of a top of the supporting frame, wherein the enclosable storage volume is provided with a reclosable flap for accessing the interior of the enclosable storage volume and wherein the flap comprises all or substantially all of the front face of the substantially cuboid fabric structure and half or substantially half of one of the sides of the substantially cuboid fabric structure.

The article of luggage of the third aspect of the present invention may incorporate any or all features of the first or second aspects of the present invention as desired or as appropriate.

In order that the invention can be more clearly understood it is now described further below with reference to the accompanying drawings, of which:

BRIEF DESCRIPTION OF THE DRAWINGS

Referring now to FIGS. 1-3, an article of luggage according to the present invention comprises a suitcase 1 having a substantially cuboid fabric structure 10 defining an enclosable storage volume 20. The fabric structure 10 comprises a base 11, a top 12, sides 13, 14, a front 15 and a rear 16 and is supported by frame 100. The frame 100 is adapted to provide support to the fabric structure 10 such that items within the storage volume 20 are protected during transport. The frame 100 is further adapted (as is discussed in more detail below) to minimise weight such that a user can maximise their baggage allowance when travelling.

DETAILED DESCRIPTION OF THE PREFERRED EMBODIMENTS

Figure 1:
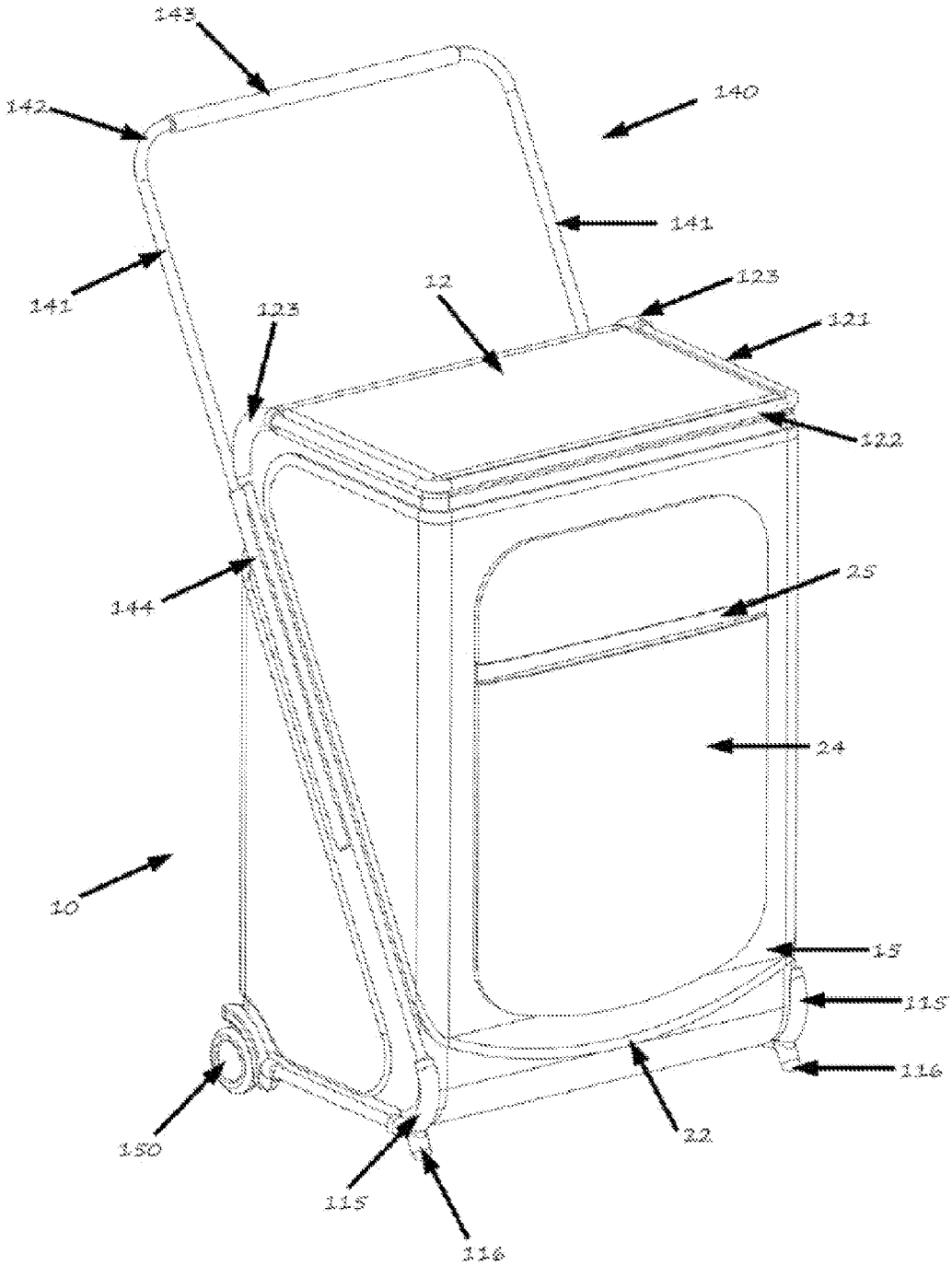
FIG. 1 shows an article of luggage according to the first aspect of the present invention.
Figure 2:
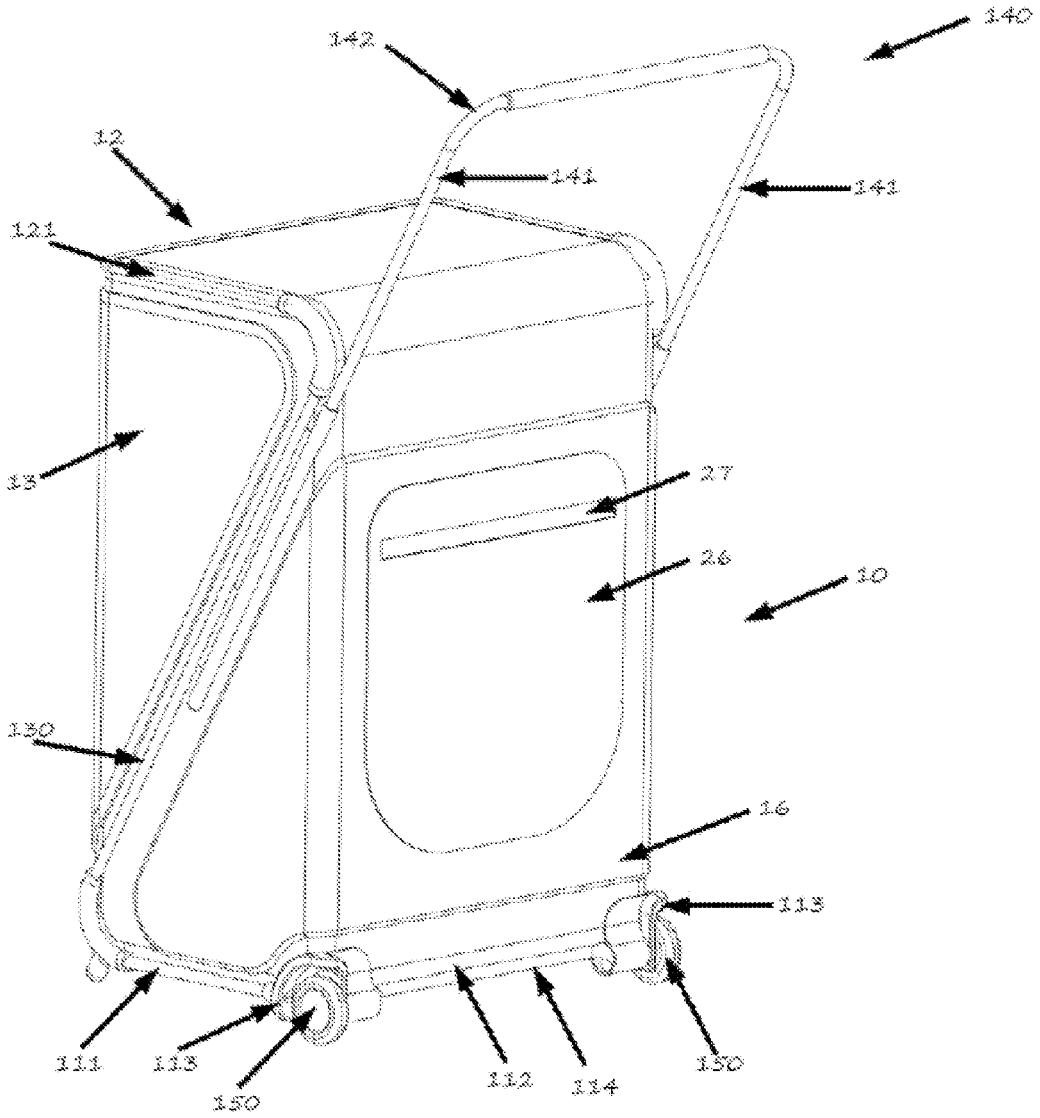
FIG. 2 shows a second view of an article of luggage according to FIG. 1.

Also mounted upon the supporting frame 100 are a set of wheels 150 and an upward and rearward projecting towing handle 140. In use, the suitcase is stable in an upright position (as is shown in FIGS. 1 & 2). A user may incline the suitcase 1 rearward from the upright position to wheel the suitcase along.

In view of the inclination of the handle 140, the suitcase 1 need not be orientated far from the vertical when being wheeled by a user. As such, the user need not support a significant proportion of the weight and the suitcase 1 is less readily upset by an uneven surface.

Figure 3:
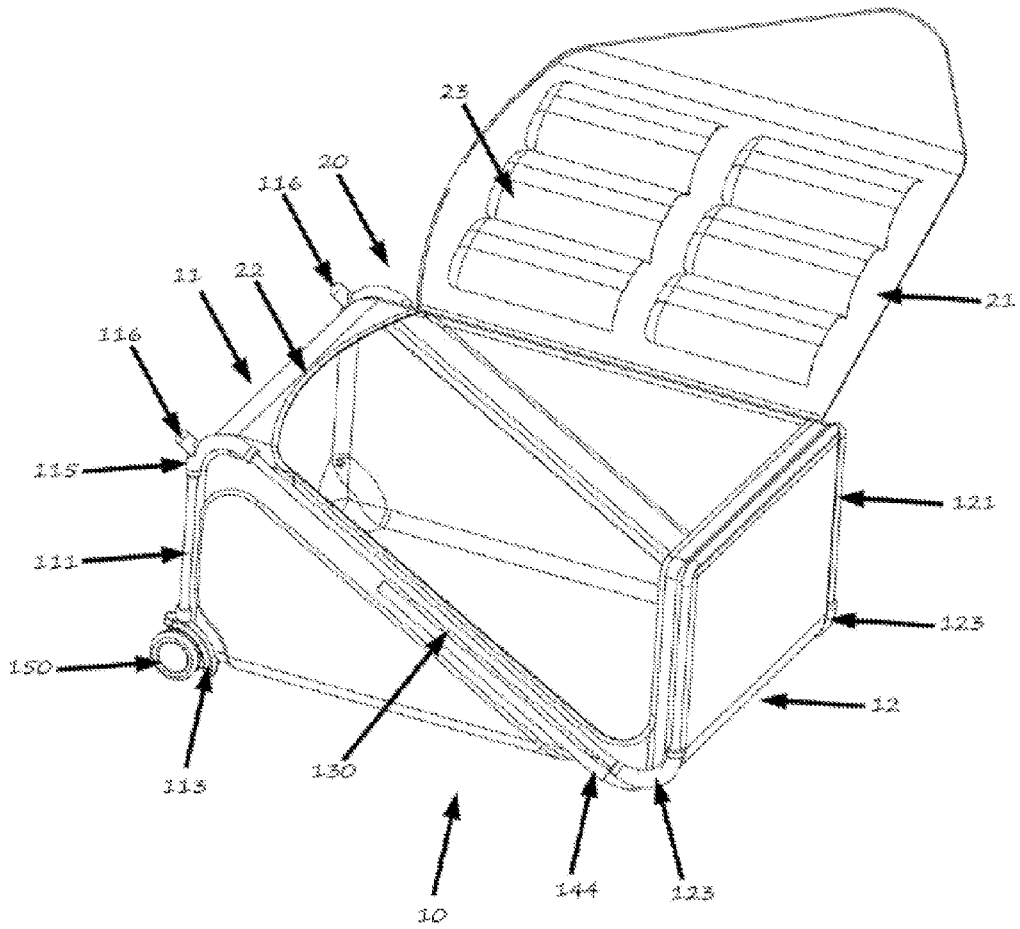
FIG. 3 shows the article of luggage of FIGS. 1 & 2 opened to allow packing/unpacking.

The handle 140 may be fixed but is preferably telescopic allowing it to be retracted, as shown in FIG. 3. This allows the suitcase 1 to be packed more easily in a confined space and ensures maximum storage volume 20 whilst complying with airline baggage restrictions.

Access to the internal storage volume 20 is provided via reclosable flap 21 which comprises substantially all of front face 15 and substantially the upper and forward half of side 13. The flap 21 is secured by zip 22 and may be provided with one or more internal pockets 23 as shown in FIG. 3. The provision of such a large access flap 21 facilitates easy packing and unpacking of the suitcase 1. In particular, the portion of the flap 21 making up half of side 13 provides ready access to items packed at the rear of the suitcase 1. It is also possible for the flap 21 and zip 22 to be extended across the upper and forward half of the other side 14 of the fabric structure 10.

In the example shown, the fabric structure 10 also has a front pocket 24 provided upon the front face 15 and a rear pocket 26 provided upon the rear face 16. The pockets are accessible and closable via respective zips 25, 27.

Figure 4:
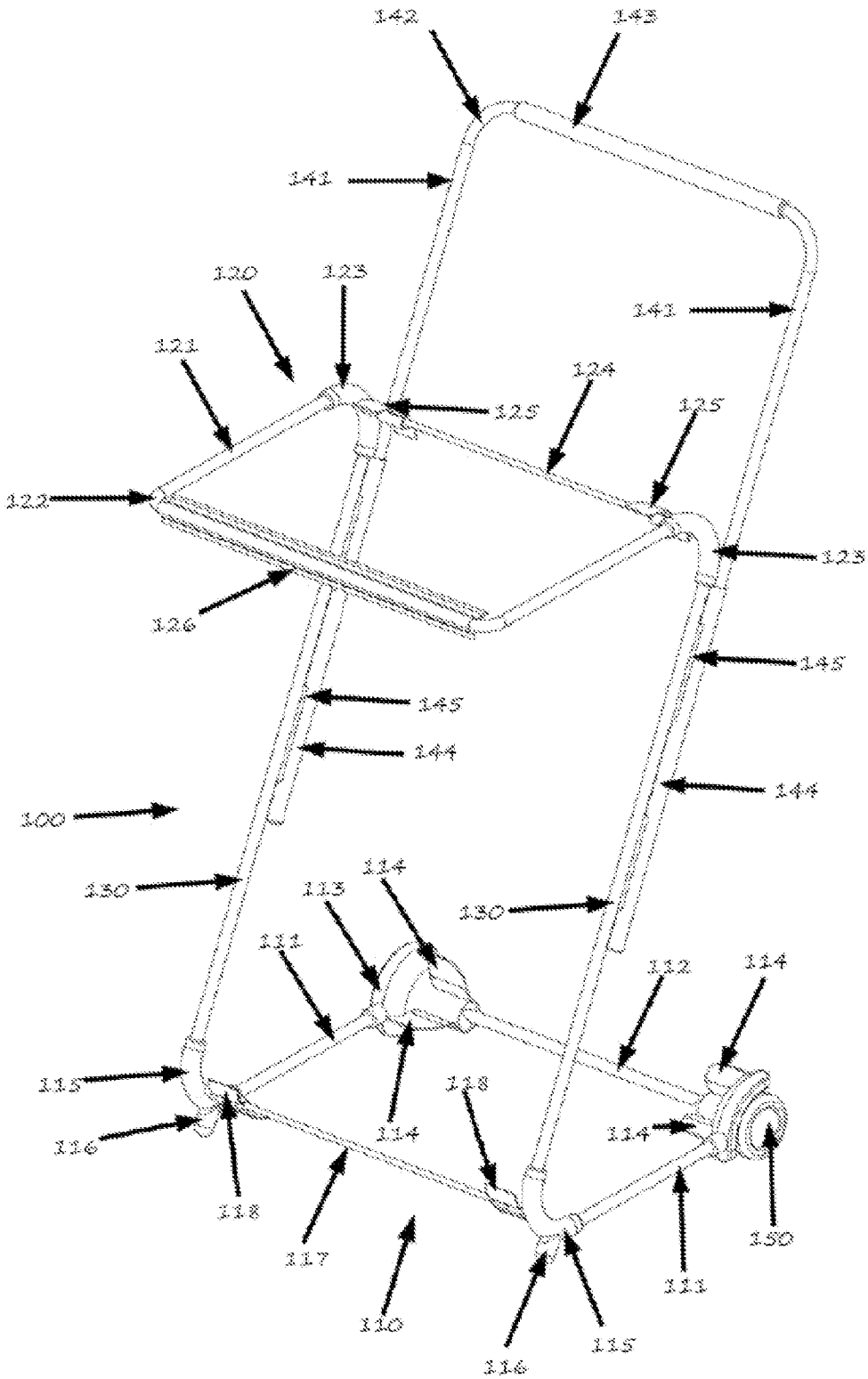
FIG. 4 shows the frame of the article of luggage of FIGS. 1-3.

Turning now to FIG. 4, the frame 100 comprises a plurality of elongate members connected together to provide a frame base 110 and a frame top 120 spaced apart by diagonal length members 130 connected between the front of the base 110 and the rear of the top 120. The handle 140 is mounted to the diagonal length members 130 and the wheels 150 are mounted to the frame base 110.

The frame base 110 comprises a rear edge member 112 and two side edge members 111. The members 111, 112 are typically aluminium tubes and are attached to corner connection joints 113 by push fitting. The corner connection joints 113 are typically plastic and adapted to provide a mounting for wheels 150. The corner connecting joints 113 further provide tabs 114 to provide a mounting for and support for the fabric structure 10.

At the front of the base 110 are provided corner connections 115 which are adapted to be attached by push fitting to both the side edge members 111 and the diagonal length members 130. The corner connections 115 are typically plastic and may typically be provided with projecting feet 116. The projecting feet 116 support the suitcase 1 when standing upright on a surface.

As described, the frame base 110 provides rigid support around three edges of the fabric base 11. Optionally, the frame base 110 may be provided with a supplementary front member 117. The supplementary member 117 may be a glass fibre rod. This thus provides some additional protection for the front edge with a lesser weight penalty than use of an aluminium member. Attached to the supplementary member 117 may be tabs 118 to provide a mounting for and support for the fabric structure 10.

The frame top 110 comprises a front edge member 122 and two side edge members 121. The members 121, 122 are typically aluminium tubes and may either be connected together via corner connection joints or may be formed as a single member bent in a U shape as shown in FIG. 4. The front edge member 122 may further be provided with an elongate tab 126 to provide a mounting for and support for the fabric structure 10.

At the rear of the frame top 120 are provided corner connections 123 which are adapted to be attached by push fitting to both the side edge members 121 and the diagonal length members 130. The corner connections 123 are typically plastic.

As described, the frame top 120 provides rigid support around three edges of the fabric top 12. Optionally, the frame top 120 may be provided with a supplementary rear member 124. The supplementary member 124 may be a glass fibre rod. This thus provides some additional protection for the rear edge with a lesser weight penalty than use of an aluminium member. Attached to the supplementary member 124 may be tabs 125 to provide a mounting for and support for the fabric structure 10.

The diagonal length members 130 are preferably aluminium tubes or the like. The diagonal length members provide support for the suitcase 1 both by rigidly spacing apart the frame base 110 and frame top 120 and by resisting sideways forces or impact. The diagonal length members also provide a convenient mounting for the handle 140, particularly if the handle 140 is telescopic. A further advantage is that diagonal length members 130 facilitate a larger access flap 21 than prior art designs.

In the example shown, the handle 140 comprises a pair of side members 141 and a cross member 142. As shown, these are formed as a single member bent in a U shape, but the skilled man would appreciate that they could be formed from three separate members connected together by suitable corner connection joints. Upon the cross member 142 is provided a handle cover 143 which may be a soft foam or similar.

As shown, the handle 140 is adapted to be received into or extended from sleeves 144. The sleeves are mounted on and parallel to diagonal length members 130 via fixings 145. For convenience, a locking mechanism, as is known in the art, may be incorporated into the sleeves 144 to retain the handle 140 in the extended position. The sleeves 144 may provide additional structural support.

In alternative embodiments, the skilled man will appreciate that it is possible to adapt the side members 141 of the handle 140 to comprise two or more telescoping sections rather than a single section. This may reduce the size of the receiving sleeve 144. It may also be possible to receive the side members 141 of the handle 140 directly into the diagonal length members 130. In order to achieve this, it would be necessary to adapt the design of the corner connection joints 123 to allow the side members 141 to pass therethrough. Whilst such a construction might result in some weight savings the additional complexity may not make it advantageous in all instances.

The skilled man will also appreciate that whilst the example embodiment described above has the fabric structure 10 provided within the frame 100, it is possible for the fabric structure 10 to enclose the frame 100 with the exception of the telescopic handle 140. This might be achieved by providing an additional layer of fabric outside the frame 100 and fabric structure 10 shown in the drawings. Alternatively, the fabric structure may comprise a single layer mounted outside the edges of the frame 100.

Figure 5:
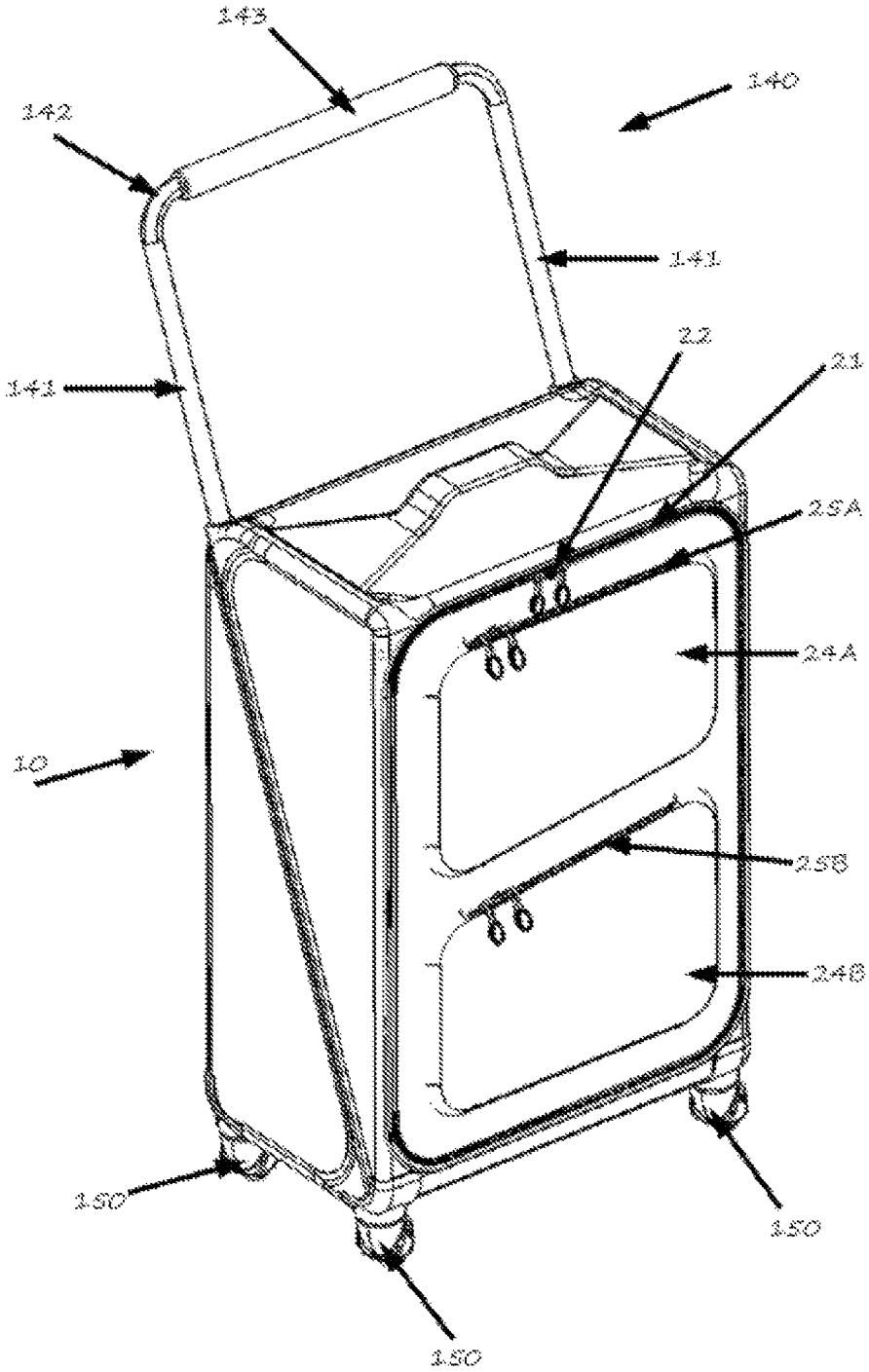
FIG. 5 shows an alternative embodiment of an article of luggage according to the first aspect of the present invention.
Figure 6:
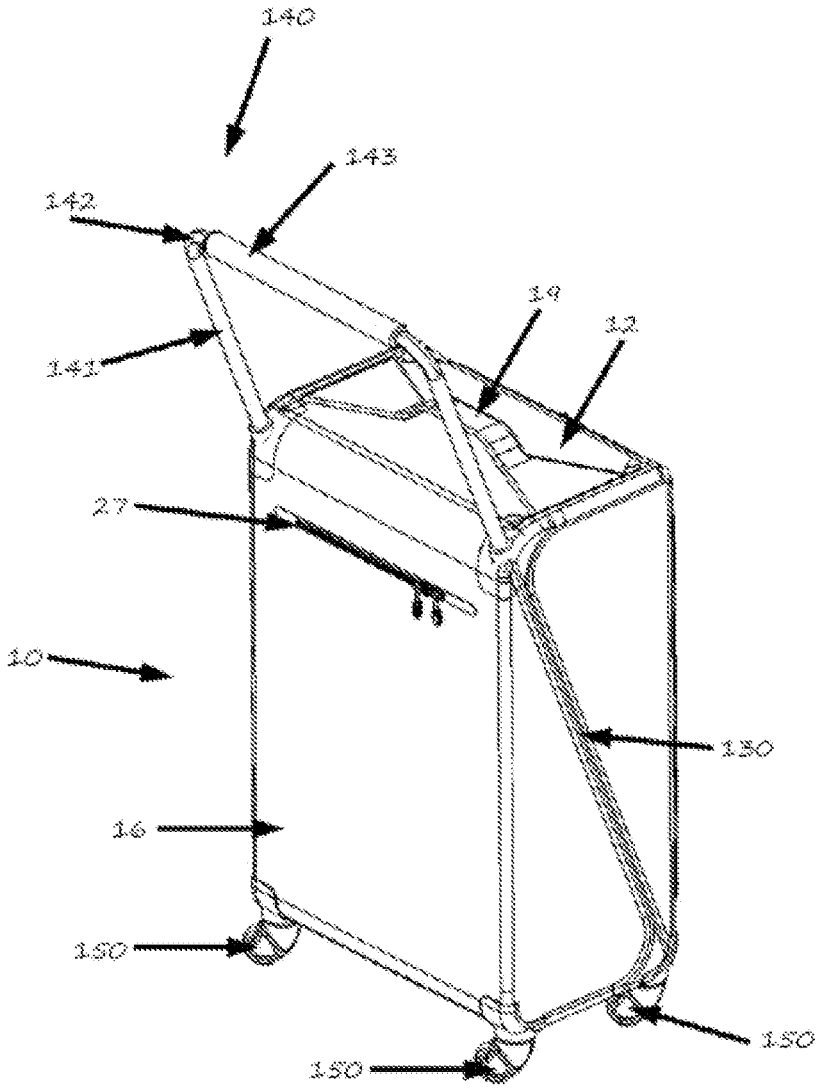
FIG. 6 shows a second view of an article of luggage according to FIG. 5.
Figure 7:
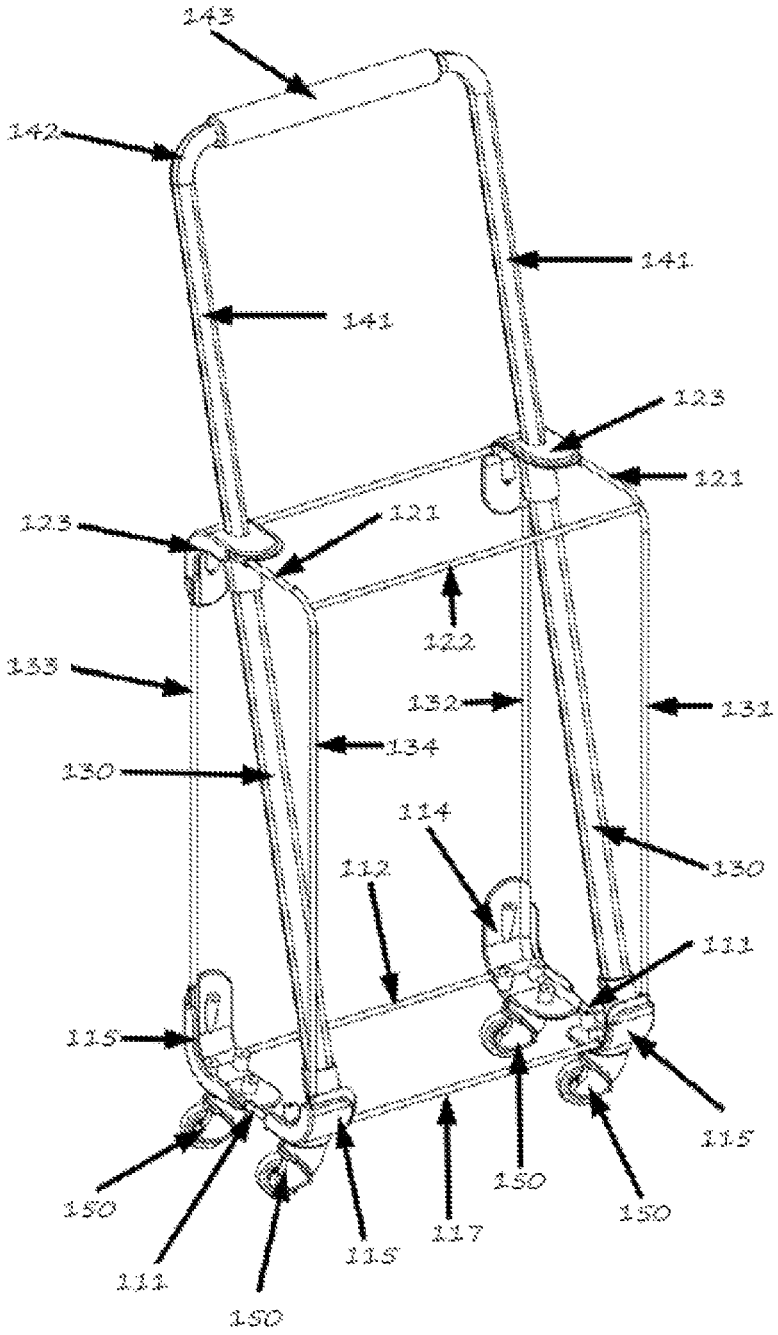
FIG. 7 shows the frame of the article of luggage of FIGS. 5 & 6.

Turning now to FIGS. 5-7, a further alternative embodiment of the present invention is shown. This embodiment is broadly similar to the first embodiment but differs from the first embodiment in a number of details. For this reason, like features in each embodiment have been labelled with the same reference numerals.

The first difference between the embodiments is the provision of parallel length members 131-134. These length members 131-134 connect corresponding vertices of the frame top 110 and frame base 120. The parallel length members 131-134 can increase the strength of the frame 100. In view of the provision of the diagonal length members 130, the parallel length members 131-134 (and/or the other various supporting members 111, 112, 117, 121, 122 & 124) can be relatively lighter than in conventional designs without adversely affecting the structural strength of the frame.

A second difference between the embodiments is that the diagonal length members 130 are expanded in diameter so as they can act as receiving sleeves for the side members 141 of handle 140. The skilled man will appreciate that separate receiving sleeves such as those shown in the first embodiment may alternatively be provided.

A third difference is that the fabric structure 10 is adapted to enclose the frame 100. As a result, the reclosable front flap 21, secured by zip 22, is restricted to substantially all of front face 15 only. In the particular example shown, two front pockets 24*a*, 24*b* are shown, accessed by zips 25*a*, 25*b* respectively. Of course, the skilled man will appreciate that the number of such pockets 24*a*, 24*b* can be varied as required.

A further difference is that the embodiment of FIGS. 5-7 is provided with additional wheels 150 in place of feet 116. The skilled man will of course appreciate that the choice of feet 116 or additional wheels 150 can be made in relation to either embodiment described. In addition to the above, the embodiment of FIGS. 5-7 is provided with a carry handle 19 upon the fabric top 12. An equivalent feature may of course be provided in the first embodiment, if desired.

It is of course to be understood that the invention is not to be restricted to the details of the above embodiments which have been described by way of example only.

The invention claimed is:

1. An article of luggage comprising:

a supporting frame;

an enclosable storage volume provided upon the supporting frame;

a set of wheels provided at a rear edge of a base of the supporting frame; and a towing handle provided at rear edge of a top of the supporting frame, and wherein the towing handle projects both upward and rearward from the article of luggage;

wherein the base of the supporting frame comprises:

a rear edge member connected to two side edge members; and a pair of substantially rigid diagonal length members connected between a front of the base of the supporting frame and a rear of the top of the supporting frame;

wherein the enclosable storage volume is provided within the supporting frame.

2. The article of luggage of claim 1, wherein the towing handle comprises a cross member provided between a pair of upward and rearward projecting members.

3. The article of luggage of claim 2, wherein the upward and rearward projecting members are adapted to extend from and be received by suitable handle sleeves.

4. The article of luggage of claim 3, wherein the handle sleeves are mounted to the supporting frame.

5. The article of luggage of claim 2, wherein the upward and rearward projecting members are telescopic.

6. The article of luggage of claim 1, wherein the enclosable storage volume is defined by a substantially cuboid fabric structure attached to the supporting frame.

7. The article of luggage of claim 6, wherein a substantially cubiod fabric structure having a front face and a plurality of sides, defines the enclosable storage volume, and a front access flap of the enclosable storage volume comprises substantially all of the front face of the substantially cuboid fabric structure and substantially half of one of the sides of the substantially cuboid fabric structure.

8. The article of luggage of claim 7, wherein the front access flap further comprises substantially half of a second one of the sides of the substantially cuboid fabric structure.

9. The article of luggage of claim 1, wherein the base of the supporting frame comprises a front edge member connected to the two side edge members; and wherein the article of luggage further comprises parallel length side members connecting each vertex of the frame top with the corresponding vertex of the frame base.

10. The article of luggage of claim 3, wherein the handle sleeves are mounted adjacent and parallel to the diagonal length members.

11. An article of luggage comprising:

a supporting frame;

an enclosable storage volume provided upon the supporting frame;

a set of wheels provided at a rear edge of a base of the supporting frame; and a towing handle provided at rear edge of a top of the supporting frame, wherein the towing handle projects both upward and rearward from the article of luggage; and wherein the base of the supporting frame comprises:

a rear edge member connected to two side edge members; and a pair of substantially rigid diagonal length members connected between a front of the base of the supporting frame and a rear of the top of the supporting frame;

wherein the enclosable storage volume encloses the frame with the exception of the towing handle.

12. The article of luggage of claim 11, wherein the towing handle comprises a cross member provided between a pair of upward and rearward projecting members.

13. The article of luggage of claim 11, wherein the upward and rearward projecting members are adapted to extend from and be received by suitable handle sleeves.

14. The article of luggage of claim 13, wherein the handle sleeves are incorporated into the supporting frame.

15. The article of luggage of claim 13, wherein the handle sleeves are mounted to the supporting frame.

16. The article of luggage of claim 12, wherein the upward and rearward projecting members are telescopic.

17. The article of luggage of claim 11, wherein the base of the supporting frame comprises: a front edge member connected to the two side edge members; and wherein the article of luggage further comprises parallel length side members connecting each vertex of the frame top with the corresponding vertex of the frame base.

18. The article of luggage of claim 11, wherein the enclosable storage volume is defined by a substantially cuboid fabric structure attached to the supporting frame.

19. The article of luggage of claim 18, wherein substantially cuboid fabric structure having a front face and a plurality of sides, defines the enclosable storage volume and a front access flap of the enclosable storage volume comprises substantially all of front face of the substantially cuboid fabric structure and substantially half of one of the sides of the substantially cuboid fabric structure.

20. The article of luggage of claim 19, wherein the front access flap further comprises substantially half of a second one of the sides of the substantially cuboid fabric structure.

21. A supporting frame for an article of luggage, the frame comprising:

a frame base having a rear edge member connected to two side edge members;

a frame top having a front edge member connected to side edge members; and a pair of substantially rigid diagonal length members connected between a front of the frame base and a rear of the frame top;

a set of wheels mounted at a rear of the frame base; and a towing handle projecting upward and rearward from the rear of the top, wherein the towing handle comprises a cross member provided between a pair of upward and rearward projecting members, and wherein the upward and rearward projecting members are telescopic.

22. The supporting frame for an article of luggage of claim 21, wherein the upward and rearward projecting members are adapted to extend from and be received by suitable handle sleeves.

23. The supporting frame for an article of luggage of claim 22, wherein the handle sleeves are mounted to the supporting frame.

* * * * *